US008127563B2

(12) United States Patent
Thiessen et al.

(10) Patent No.: US 8,127,563 B2
(45) Date of Patent: Mar. 6, 2012

(54) LINEAR-COMPRESSOR CONTROL SYSTEM, A METHOD OF CONTROLLING A LINEAR COMPRESSOR AND A LINEAR COMPRESSOR

(75) Inventors: Marcio Roberto Thiessen, Joinville (BR); Paulo Sergio Dainez, Joinville (BR)

(73) Assignee: Whirlpool S.A., Sao Paulo-SP (BR)

( * ) Notice: Subject to any disclaimer, the term of this patent is extended or adjusted under 35 U.S.C. 154(b) by 778 days.

(21) Appl. No.: 12/093,001

(22) PCT Filed: Nov. 9, 2006

(86) PCT No.: PCT/BR2006/000246

§ 371 (c)(1),
(2), (4) Date: Aug. 5, 2008

(87) PCT Pub. No.: WO2007/053922

PCT Pub. Date: May 18, 2007

(65) Prior Publication Data

US 2008/0314056 A1 Dec. 25, 2008

(30) Foreign Application Priority Data

Nov. 9, 2005 (BR) ..... 0505060

(51) Int. Cl.
*F25B 1/00* (2006.01)
*F25B 49/00* (2006.01)

(52) U.S. Cl. ..... 62/228.3; 62/228.1; 62/228.4; 417/12; 417/44.1; 417/44.2

(58) Field of Classification Search ..... 62/228.1, 62/228.3, 228.4; 318/599, 811; 388/800, 388/804, 811, 819; 417/12, 44.1, 44.2, 53
See application file for complete search history.

(56) References Cited

U.S. PATENT DOCUMENTS 4,537,038 A * 8/1985 Alsenz et al. ..... 62/118
4,863,355 A * 9/1989 Odagiri et al. ..... 417/12
6,623,246 B2 * 9/2003 Hwang et al. ..... 417/44.1

(Continued)

FOREIGN PATENT DOCUMENTS

EP 1 489 368 12/2004

(Continued)

OTHER PUBLICATIONS

The International Search Report for PCT Application No. PCT/BR2006/000246; Filed Nov. 11, 2006; Date of Completion Feb. 6, 2007; Date of Mailing Feb. 16, 2007.

(Continued)

*Primary Examiner* — Cheryl J Tyler
*Assistant Examiner* — Paolo Gonzalez
(74) *Attorney, Agent, or Firm* — Alston & Bird LLP

(57) ABSTRACT

A linear compressor control system includes an electronic circuit controlling an electric motor that drive a piston of the compressor, such that the motor is operated intermittently with an on-time ($t_L$) and an off-time ($t_D$) to keep the compression capacity of the compressor substantially constant. The compressor is associated with a closed cooling circuit having an evaporator and a condenser. The off-time ($t_D$) is shorter than the time necessary for the evaporation pressure ($P_E$) in the evaporator and the condensation pressure (Pc) in the condenser to equalize each other after the compressor has been turned off.

15 Claims, 6 Drawing Sheets

U.S. PATENT DOCUMENTS

| | | | | |
|---|---|---|---|---|
| 6,626,651 | B2 * | 9/2003 | Akazawa et al. | 417/417 |
| 6,663,348 | B2 * | 12/2003 | Schwarz et al. | 417/12 |
| 6,877,326 | B2 * | 4/2005 | Kim | 62/6 |
| 7,836,715 | B2 * | 11/2010 | Eisenhour | 62/228.1 |
| 2002/0062652 | A1 * | 5/2002 | Hwang et al. | 62/228.3 |
| 2002/0064464 | A1 * | 5/2002 | Hwang et al. | 417/44.11 |
| 2003/0177773 | A1 | 9/2003 | Kim | |
| 2003/0209015 | A1 * | 11/2003 | Song | 62/6 |
| 2003/0213256 | A1 * | 11/2003 | Ueda et al. | 62/230 |
| 2004/0168453 | A1 * | 9/2004 | Schwarz et al. | 62/230 |
| 2005/0271519 | A1 * | 12/2005 | Hong et al. | 417/44.11 |
| 2006/0140777 | A1 * | 6/2006 | Berwanger et al. | 417/53 |
| 2006/0171814 | A1 * | 8/2006 | Dainez et al. | 417/44.1 |
| 2006/0228224 | A1 * | 10/2006 | Hong et al. | 417/44.1 |
| 2006/0257264 | A1 * | 11/2006 | Kim et al. | 417/44.1 |
| 2007/0095073 | A1 * | 5/2007 | Tian et al. | 62/6 |
| 2007/0113569 | A1 * | 5/2007 | Oh et al. | 62/228.1 |

FOREIGN PATENT DOCUMENTS

| | | | |
|---|---|---|---|
| WO | WO 2004063569 | A1 * | 7/2004 |
| WO | WO 2005071265 | A1 * | 8/2005 |

OTHER PUBLICATIONS

The Written Opinion for PCT Application No. PCT/BR2006/000246; Filed Nov. 11, 2006; Date of Completion Feb. 6, 2007; Date of Mailing Feb. 16, 2007
The Response to Written Opinion Dated Sep. 9, 2007.
The International Preliminary Report on Patentability.
Notification of Applicant Change of Address Dated May 5, 2008.

* cited by examiner

LINEAR-COMPRESSOR CONTROL SYSTEM, A METHOD OF CONTROLLING A LINEAR COMPRESSOR AND A LINEAR COMPRESSOR

BACKGROUND OF THE INVENTION

1. Field of the Invention

The present invention relates to a linear-compressor control system, to the respective control method, and to the linear control incorporating the control system of the present invention.

2. Description of the Prior Art

The basic objective of a cooling system is to keep a low temperature inside one (or more) compartment(s) (or even closed environments, in the cases of air-conditioning systems), making use of devices that transport heat from the inside of said compartment(s) to the external environment, taking advantage of the measurement of the temperature inside this (these) environment(s) to control the devices responsible for transporting heat, seeking to maintain the temperature within pre-established limits for the type of cooling system in question.

Depending on the complexity of the cooling system and on the type of application, the temperature limits to be kept are more or less restricted.

A common form of transporting heat from the interior of a cooling system to the external environment is to use an air-tight compressor connected to a closed circuit, which includes an evaporator and a condenser through which a cooling fluid circulates, this compressor having the function of promoting the cooled gas flow inside this cooling system, being capable of imposing a determined difference in pressure between the points where evaporation and condensation of the cooling gas occur, enabling the heat-transport process and the creation of a low temperature to take place.

Compressors are dimensioned so as to have the capacity of cooling higher than that necessary in a normal operation situation, critical demand situations being foreseen, wherein some type of modulation of the cooling capacity of this compressor is necessary to keep the temperature inside the cabinet within acceptable limits.

The most common form of modulating the cooling capacity of a conventional compressor is to turn it on and off, according to the temperature inside the cooled environment, taking advantage of the thermostat, which switches on the compressor when the temperature in the cooled room rises above the pre-established limit and switches it off when the temperature inside this environment has reached an equally pre-established lower limit, these limits being established in such a way that the pressures will equalize. Such a phenomenon can be observed in FIGS. 1 and 2. As disclosed therein, the average temperature $T_M$ oscillates, and the compressor is turned on and off when ever the temperature measured at a determined instant is above the desired level. The variation of the cooling fluid pressure can be observed in FIG. 2; it can be noted that the condensation pressure $P_C$ jumps significantly up and, at the same time, the evaporation pressure $P_E$ is reduced because of the loss of heat of the gas in the evaporator. Once the compressor has been turned off, the condensation pressure $P_C$ drops and the evaporation pressure $P_E$ rises, until they equalize, that is to say, until they are equal. The equalization of the condensation pressure $P_C$ and the evaporation pressure $P_E$ occurs because the cooling fluid, which was impelled by the (now off) compressor, spreads through the tubing until the pressure becomes equal at all the points.

For compressors having variable capacity, the control is performed by changing the compressor's rotation, that it to say, when the temperature of the cooled environment rises above a certain pre-established limit, the thermostat installed within the cooling system commands the compressor to raise rotation and, as a result, the capacity also rises until the temperature returns to the previous state, the moment when the rotation is decreased. However, for constructive reasons, there is a limit for the minimum rotation, and, if it is necessary to decrease the rotation to values lower than the minimum rotation, it will be necessary to turn off the compressor.

The behavior of a compressor having variable capacity can be observed in FIGS. 3 and 4, the variation in behavior of the condensation pressure $P_C$ and of the evaporation pressure $P_E$ in function of the average temperature $T_M$ being analogous to that of a conventional compressor, that is to say, once the compressor has been turned off, the condensation $P_C$ and the evaporation pressures $P_E$ equalize.

In the case of a linear compressor having variable capacity, the capacity is controlled by varying the volume displaced by the piston. This control is given by a signal from the thermostat installed within the cooling system, which commands the compressor to raise capacity (displaced volume) until the temperature returns to the previous state and again the displaced volume is diminished.

According to the teachings of the prior art, the control of the capacity of a conventional compressor presents problems due to the characteristics intrinsic in this type of equipment. As it is well known, in practice one does not manage to start a conventional compressor without the pressures of the cooling being equalized. This is because, in order for a conventional compressor to be started with non-equalized pressures, one has to use a high-torque starting motor which is too expensive, in addition to the problems with excessively high starting current which makes it unfeasible for this type of application. In this regard, one observes that a function of a variable-capacity compressor is exactly to prevent the pressures of the system from becoming unequalized, in order to prevent the need to stop the equipment for allowing the cooling-fluid pressures to remain equalized.

The result of this characteristic is that the compressor should work for long periods (within range of minutes) and be kept off for long periods as well (within range of minutes), in order to guarantee, at the same time, that the environment will reach the desired temperature and the cooling-fluid pressures will become equalized while the compressor is off, and the latter can be started again.

Another problem resulting from the use of compressors (be they of the variable-capacity type or common type) lies in the fact that, when the equipment is turned off, the fluid backflow inside the cooling circuit results in a loss of heat, since the pressure of the fluid compressed by the compressor will disperse or equalize with the rest of the pressure of the cooling circuit.

In addition to this drawback, compressors still have the problem of generating noise at the start, further requiring high electric starting current, which results in a higher consumption of electricity.

Since conventional compressors have the same characteristics, the knowledge of the present invention can be applied to rotary compressors that have application in domestic cooling systems and chiefly in air-conditioning systems.

When one makes use of a linear compressor, the capacity is altered, whereby the dead volume of the compressor (smaller displacement) is increased. This process causes the capacity to decrease and, as a result, there is a decrease in the efficiency of the compressor, caused by the increase in dead volume. In systems that operate with a low frequency (feed network frequency), there is still an additional loss due to the fact that the compressor undergoes a variation of its mechanical resonance frequency. In order to minimize this effect in systems with a fixed frequency, the compressor is adjusted to operate at the minimum capacity at a determined evaporation and condensation (optimum for this condition). Since the frequency is fixed and the compressor capacity is varied from the minimum to the maximum, the optimum functioning point also changes and the compressor loses approximately from 11 to 15% in efficiency.

BRIEF SUMMARY OF THE INVENTION

In order to overcome the problems of the prior art, one has the objective of providing a linear-compressor control system, the respective control method, as well as a linear compressor properly speaking, which, at the same time, will overcome the functional and efficiency problems that occur when using conventional and variable-capacity compressors, so as to achieve an exact control of the temperature of the environment to be cooled and also to overcome the problem of low efficiency of the solution in which a linear compressor is controlled by increasing the dead volume. Thus, one aims at enabling this equipment to operate at the maximum efficiency possible in the cooling system and, consequently, recover the 11-15% efficiency lost in the systems configured in accordance with the teachings of the prior art.

In order to achieve these objectives of the present invention, one makes use of one of the characteristics of a linear compressor, which is the capability of starting it independently of the fact that the evaporation pressure and the condensation pressure are equalized or not. Thus, one bears in mind that linear compressors, unlike conventional compressors, do not have restrictions as to the starting with non-equalized pressures, high starting currents and starting and stopping noises. In these cases a linear compressor may be turned on and off at very short stoppage and functioning periods (seconds). By using these characteristics of linear compressors, according to the present invention one provides a on/off-type compressor with very short on and off times and can thereby vary its capacity. These times should be established so that the suction and discharge pressures will not vary significantly, whereby one achieves a temperature stability that conventional on/off compressors cannot provide. In this way, one can modulate the capacity of a compressor from 0 to 100%.

BRIEF DESCRIPTION OF THE DRAWINGS

The present invention will now be described in greater detail with reference to an embodiment represented in the drawings. The figures show.

DETAILED DESCRIPTION OF THE DRAWINGS

Figure 9:
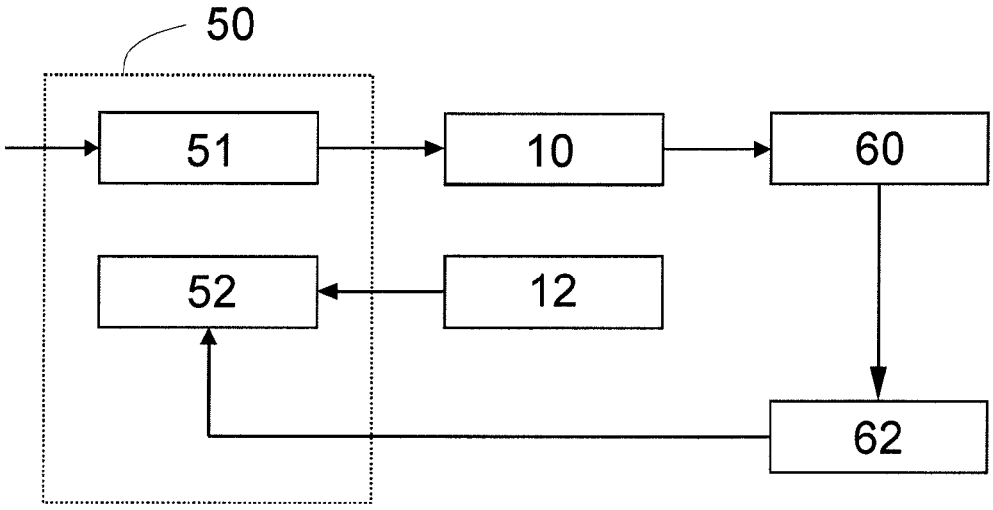
FIG. 9 shows a schematic diagram of a cooling system in which the teachings of the present invention are applicable.
Figure 10:
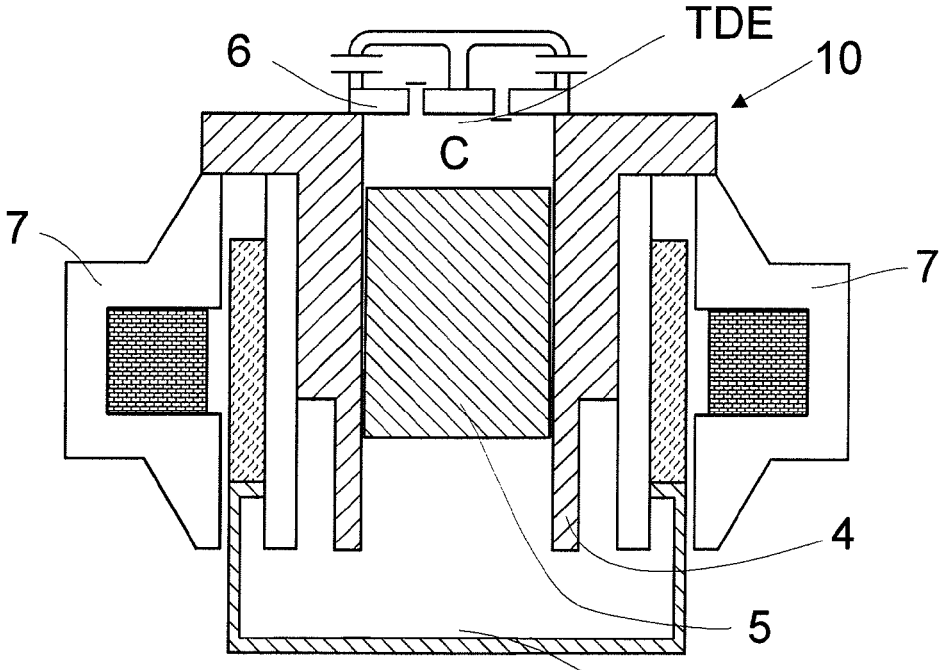
FIG. 10 shows a schematic sectional view of a linear compressor.

As can be seen in FIGS. 9 and 10, the linear-compressor control system comprises the linear compressor 10, controlled by an electronic circuit 50, through an electric motor 7.

Structurally the linear compressor 10 comprises basically a cylinder 4 and a piston 5. The piston 5 is placed within the cylinder 4, the cylinder being closed by a valve plate 6 so as to form a compression chamber C. Dynamically the piston 5 is driven by the electric motor 7 for axial displacement inside the cylinder 4 along a piston stroke and between top dead end (TDE) and a bottom dead end (BDE), the cooling fluid being compressed within the compression chamber C close to the top dead end (TDE).

The electric motor 7 is associated to a set of TRIACs 51, which is switched through an electronic control 52, which may be, for instance, a microprocessor or a similar device. Associated to the linear compressor 10, one may provide a displacement sensor 12, which can control variables such as position, velocity or even position of the piston 10.

A linear compressor is usually associated to a cooling system or an air-conditioning system 60, which comprises a temperature sensor for sensing the temperature of the cooled environment and that feeds the electronic control 52 through an electronic thermostat 62.

Figure 11:
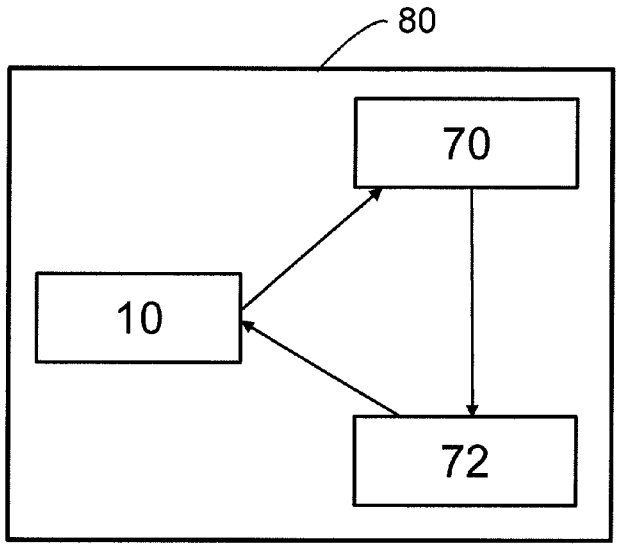
FIG. 11 shows a simple cooling closed circuit.
Figure 12:
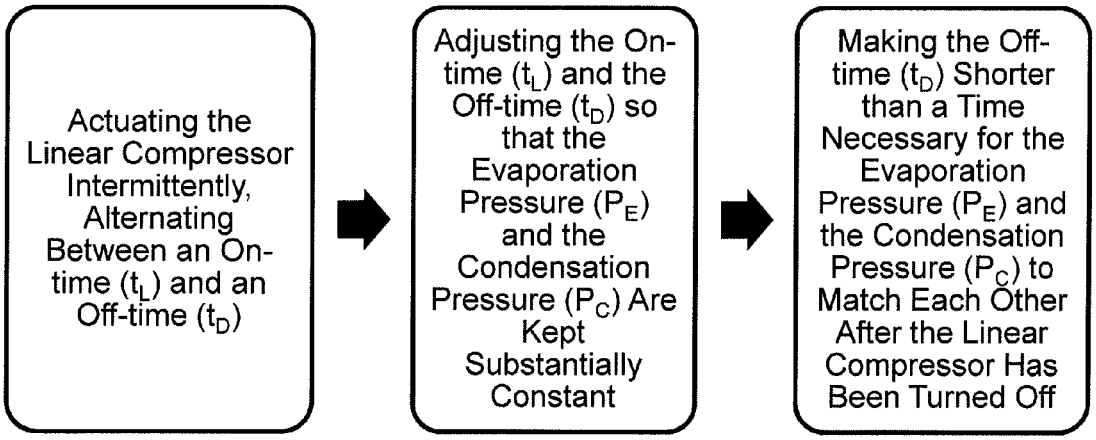
FIG. 12 shows steps of a method of controlling a linear compressor in accordance with an embodiment of the invention.

In addition to the linear compressor 10 and of the electronic circuit 50, the compressor-control system further has a cooling closed circuit (80) that comprises an evaporator (72) and a condenser (70), as shown in FIG. 11. Thus, as the linear compressor 10 comes into operation, the piston 5 compresses fluid/gas into the compression chamber C and discharging it in to the cooling closed circuit (80), thereby generating an evaporation pressure $P_E$ within the evaporator (72) and a condensation pressure $P_C$ within the condenser (70). As known from the prior art, these evaporation $P_E$ and condensation $P_C$ pressures oscillate depending on the state of the linear compressor 10, that is to say, when the linear compressor 10 is acting, the condensation pressure $P_C$ has a high level and the evaporation pressure $P_E$ drops, whereas at the moment when the linear compressor stops operating, these condensation pressure $P_C$ and evaporation pressure $P_E$ equal each other, generating the problems already described before.

In order to prevent the known problems from occurring, one foresees, with the compressor control system, or still with the compressor incorporating the system, as well as with the compressor-controlling method according to the present invention, that the evaporation pressure $P_E$ and the condensation pressure $P_C$ should be kept substantially constant throughout the operation time of the linear compressor 10, as can be observed in the graphs of FIGS. 5 to 8.

This control is effected by modulating adequately the operation times of the linear compressor, causing it to operate intermittently in short periods of time, obtaining the desired capacity value of the linear compressor 10, through an average value of on-time $t_L$. This is done through the electronic circuit 50 that controls the electric motor 7 in an intermittent manner, through the on-time $t_L$, an off-time $t_D$ throughout the operation of the linear compressor 10.

During the on-time $t_L$, the electric motor 7 is actuated by the electronic circuit 50 with a constant frequency, while the piston stroke is kept constant, which generates a constant compression capacity throughout the period in which the electronic circuit 50 controls the electric motor 7 for the latter to be operating during the on-time $t_L$. In this condition of operation of the linear compressor 10, according to the system of the present invention, the electronic circuit 50 should control or modulate the on-time $t_L$ and the off-time $t_D$, so that the compression capacity will be kept substantially constant throughout the operation time of the linear compressor 10, as can be observed in FIGS. 5 to 8 and, in greater details, in FIGS. 7 and 8.

Although the system and the respective method are preferably usable at a low frequency, one also foresees the use in a variable-frequency system. This variation in frequency has the objective of actuating the compressor at the resonance frequency, the value of the variation in frequency being typically lower than 5%, not causing a significant capacity variation. In this case, one should foresee the necessary adaptation in the system, so that the actuation of the piston will accompany the variation of the resonance frequency. Examples of the use of frequency adjustment can be found in patents WO/2005/071265 and WO/2004/063569, the description of which are incorporated herein by reference.

By configuring the system in this way, one puts an end to the problem of loss of efficiency, which is typically of 11 to 15% in linear compressors operated so as to have a variable piston stroke, as well as prevents the problem of backflow of the cooling fluid in the cooling closed circuit (80).

In order to achieve this situation of no backflow of cooling fluid, one should control the on-times $t_L$ and the off-times $t_D$ of the linear compressor 10 in an adequate manner. For this purpose, one should observe which constructive characteristics are peculiar to each cooling closed circuit (80), to conclude what is the time of equalization of the evaporation pressure $P_E$ and condensation pressure $P_C$ and design the compressor control system so as to prevent the linear compressor 10 from being off for longer than the time necessary for said pressure equalization to take place. In other words, the system of controlling the linear compressor should have the electronic circuit 50 configured to have the off time $t_D$ shorter than a time necessary for the evaporation pressure $P_E$ and condensation pressure $P_C$ to equal after the linear compressor 10 has been turned off.

Figure 1:
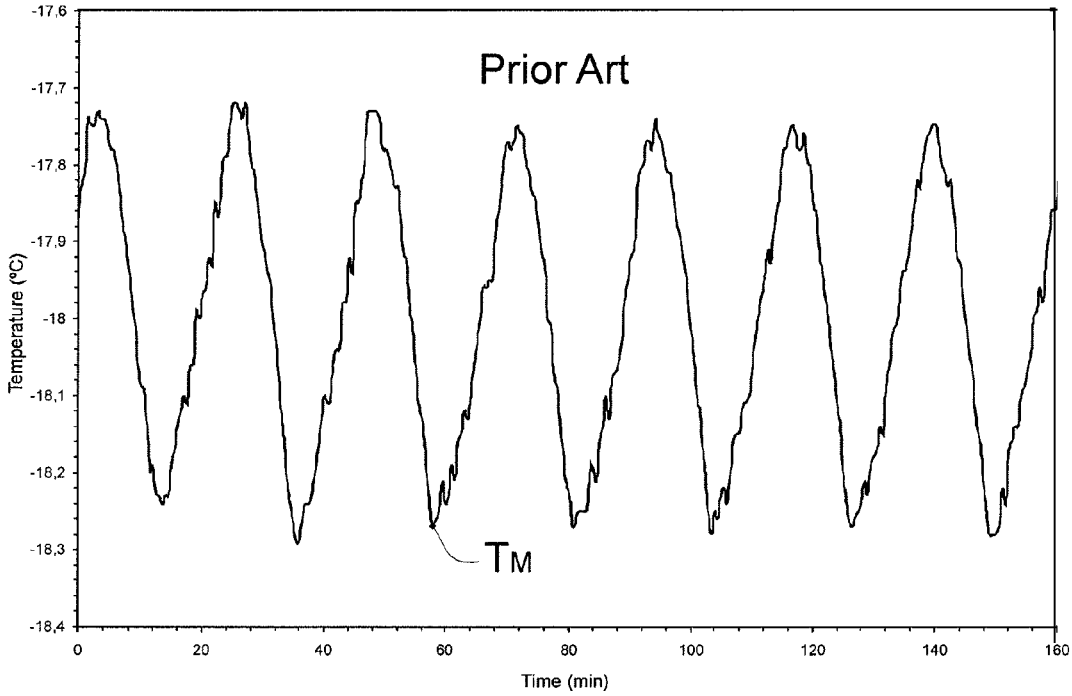
FIG. 1 shows a graph of the internal average temperature of a cooling cabinet using a conventional compressor in the prior art.
Figure 2:
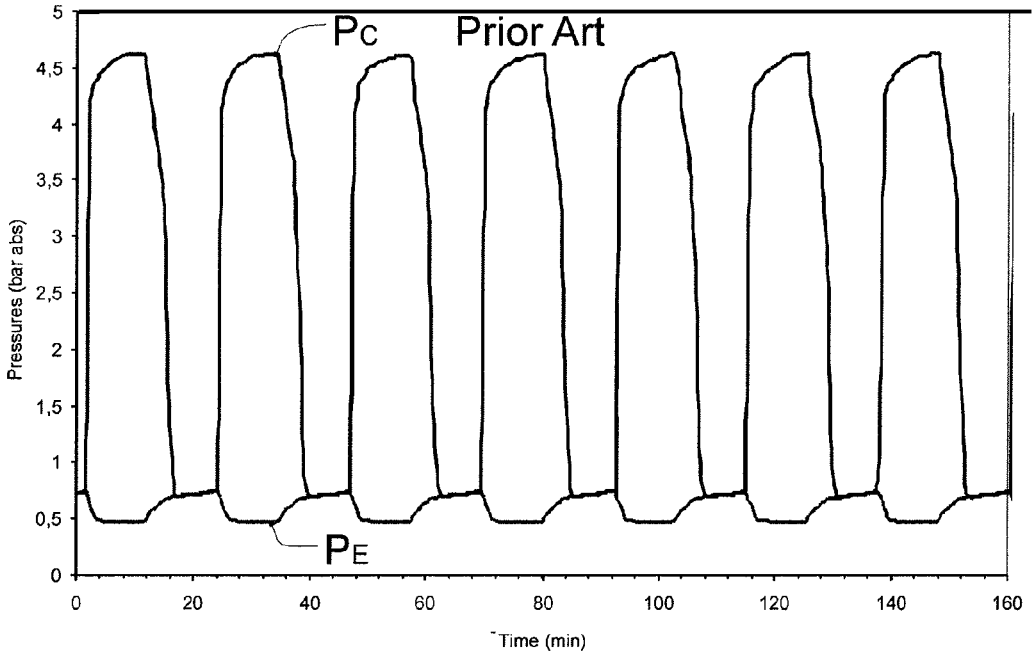
FIG. 2 shows a graph of the evaporation and condensation pressures of a conventional compressor in the prior art.
Figure 3:
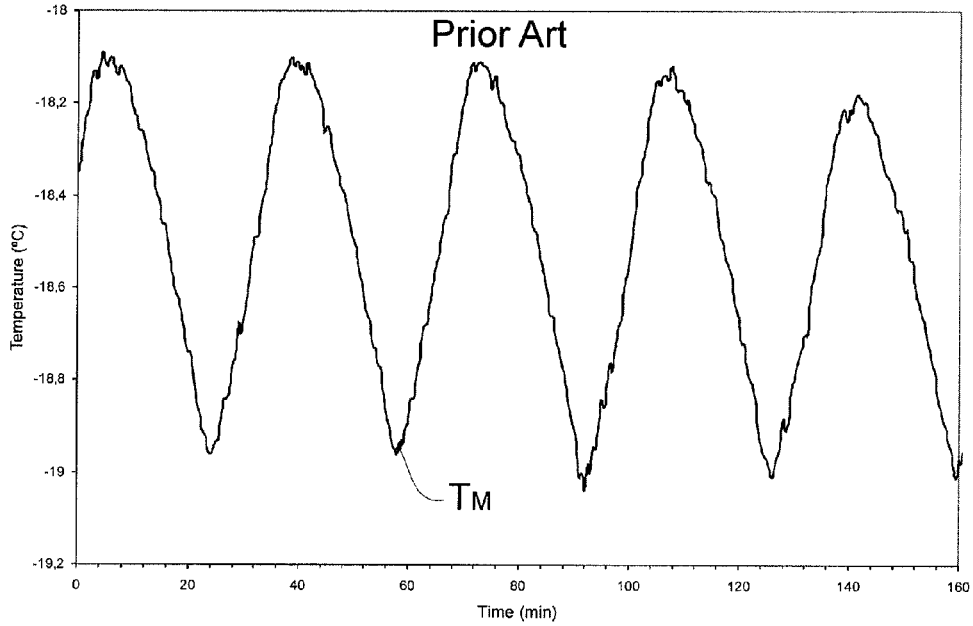
FIG. 3 shows a graph of the internal temperature of a cooling cabinet using a variable-capacity compressor in the prior art.
Figure 4:
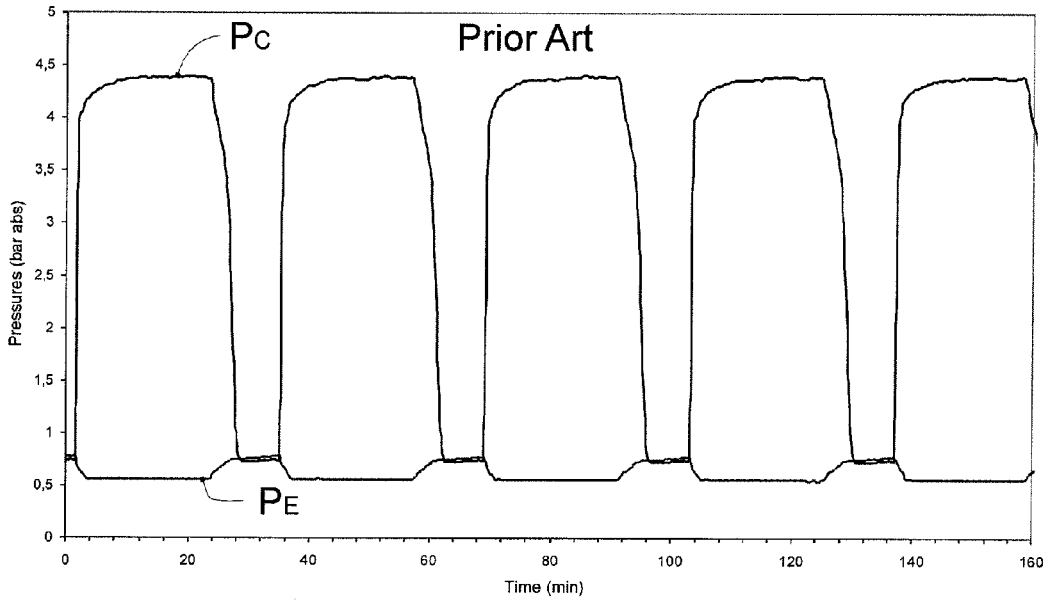
FIG. 4 shows a graph of the evaporation and condensation pressures of a variable-capacity compressor in the prior art.
Figure 5:
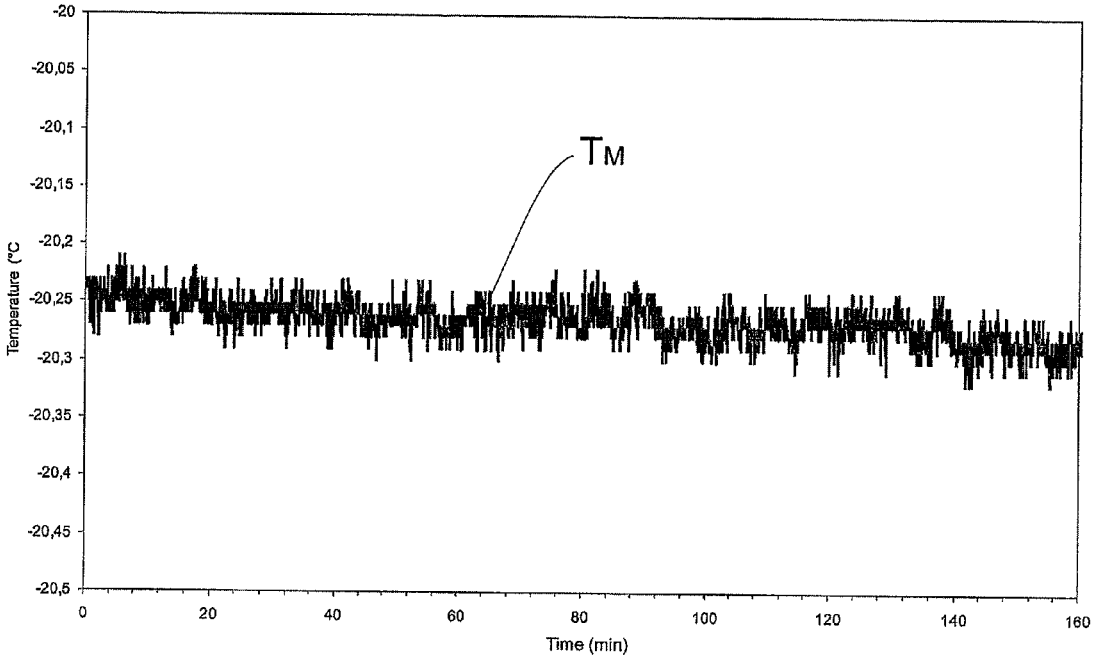
FIG. 5 shows a graph of the internal temperature of a cooling cabinet using a short-cycle linear compressor according to the teachings of the present invention.
Figure 6:
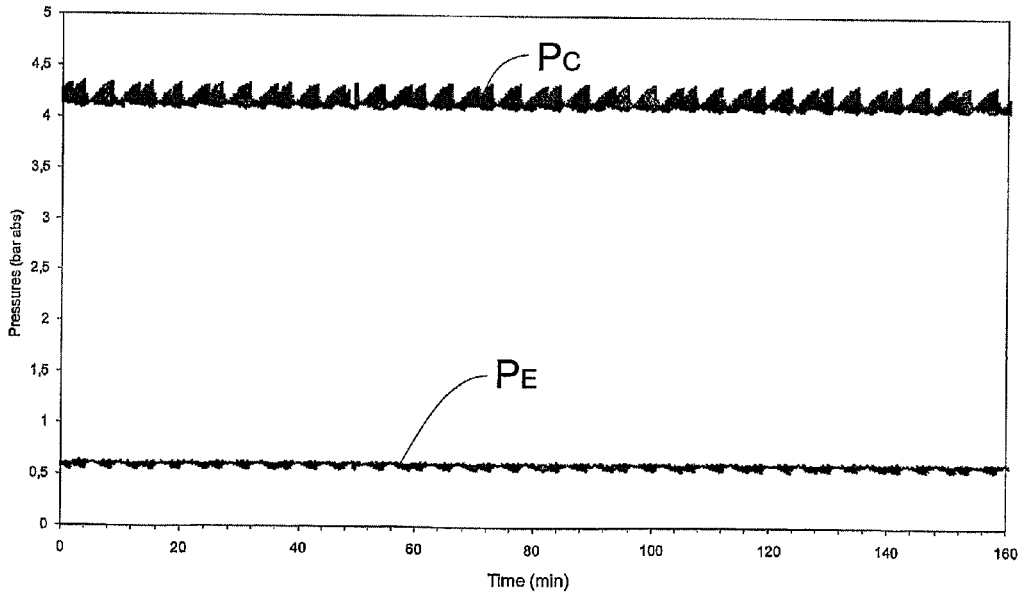
FIG. 6 shows a graph of the evaporation and condensation pressures of a compressor using a short-cycle linear compressor according to the teachings of the present invention.
Figure 7:
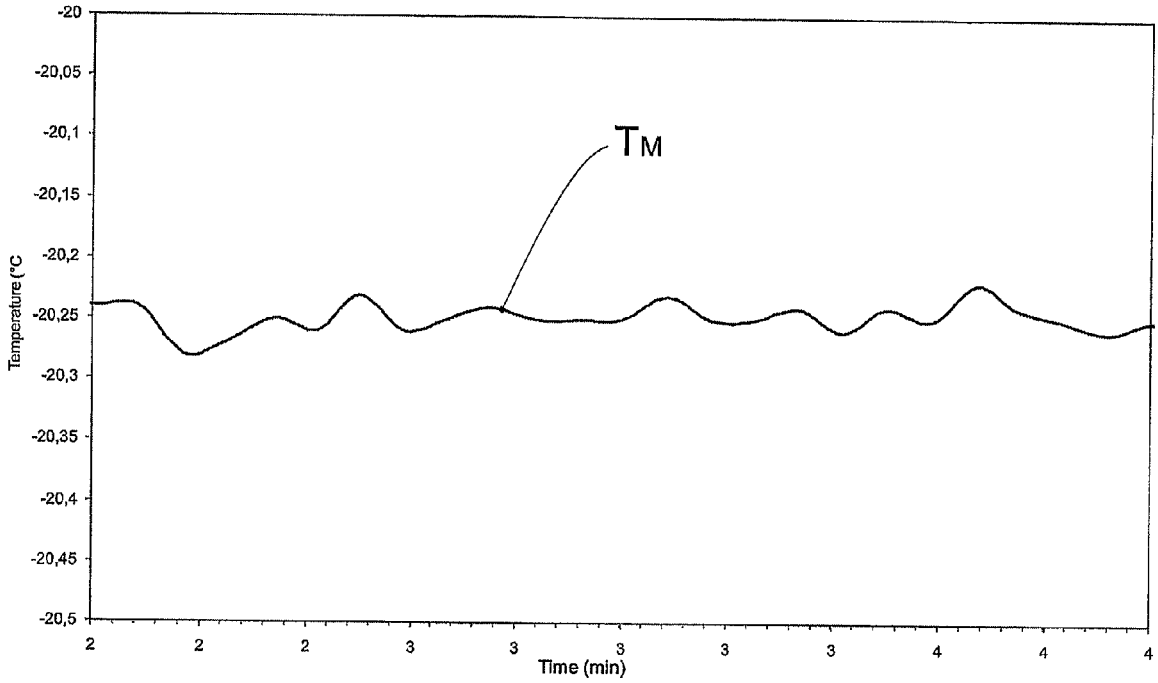
FIG. 7 shows an enlarged graph of the internal average temperature of a cooling cabinet using a short-cycle linear compressor according to the teachings of the present invention.
Figure 8:
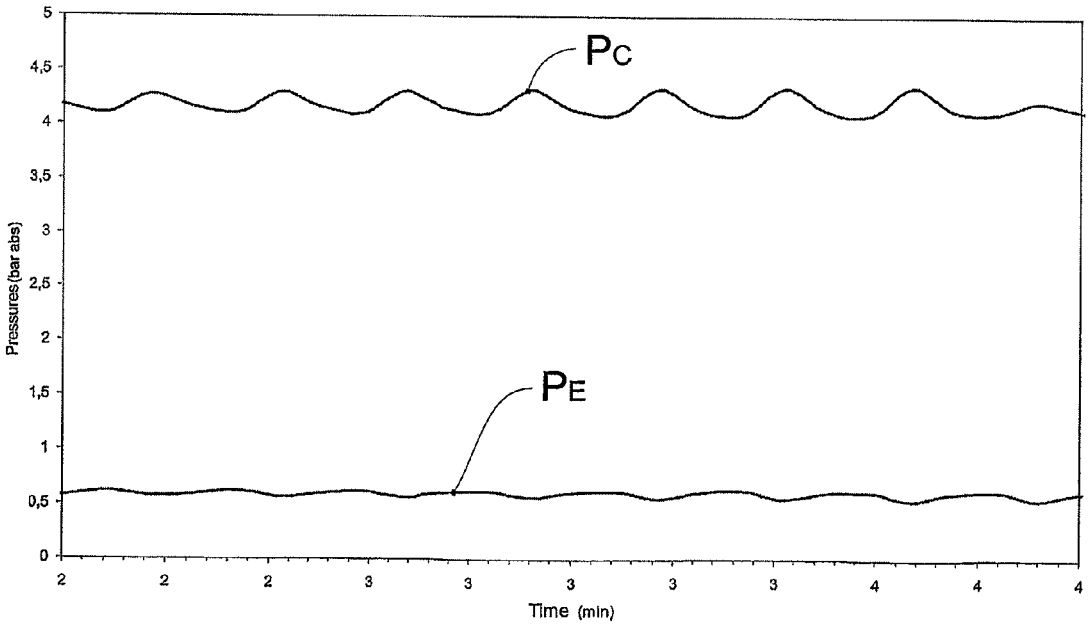
FIG. 8 shows an enlarged graph of the evaporation and condensation pressures of a compressor using a short-cycle linear compressor according to the teachings of the present invention.

Among the typical operation values, for instance, the behavior of a conventional compressor as illustrated in FIGS. 1 and 2, or even in the case of a variable-capacity compressor as illustrated in FIGS. 3 and 4, one can observe that the on-time $t_L$ and the off-time $t_D$ are within a range of minutes, for example, $t_L$=10.5 min×$t_D$=11.5 min, in the case of a conventional compressor; and $t_L$=22.5 min×$t_D$=11.5 min in the case of a variable-capacity compressor (in the case of a variable-capacity compressor one should take into consideration that these times vary according to the rotation speed of the compressor).

The table below exemplifies the usual values of on-time $t_L$ and off-time $t_D$ in conventional compressors and variable-capacity compressors:

| Conventional compressors | | Variable-capacity compressors | |
|---|---|---|---|
| $t_L$ (minutes) | $t_D$ (minutes) | $t_L$ (minutes) | $t_D$ (minutes) |
| 5 | 5 | 14 | 25 |
| 4 | 10 | 18 | 10 |
| 10 | 17 | 20 | 12 |
| 10 | 19 | 32 | 14 |
| 10 | 40 | 58 | 18 |
| 40 | 40 | 317 | 8 |
| 46 | 52 | | |
| 73 | 52 | | |
| 103 | 103 | | |

Typically in a conventional compressor on-times $t_L$ and off-time $t_D$ are about 50% on for normal operational conditions, and those of a variable-capacity compressor are between 60% to 90% of on-time $t_L$ and this time of the variable-capacity compressor is similar to the on-time of the linear compressor in the traditional operation mode.

Thus, unlike this operation logic, according to the teachings of the present invention, the linear compressor will be on and off in the range of seconds (instead of minutes), operating with off-times $t_D$ and on-times $t_L$ typically in the range of 10 to 15 seconds.

As a guidance, one can consider that the off-time $t_D$ of the linear compressor 10 is from 10% to 20% of the time necessary for the evaporation pressure $P_E$ and condensation pressure $P_C$ to match after turning off the linear compressor 10, and one can also opt for operating with the on-time $t_L$ of the linear compressor 10, which is equal to the off-time $t_D$.

In general terms, one can define the off-time $t_D$ as being the maximum time of 20% of the time which the system takes to equalize the pressures, since for a time longer than 20%, typically one can already note a very great loss of pressure, which decreases the efficiency of the cycle; and 10% as a minimum time of the off-time $t_D$, since shorter times also impair the efficiency. In this way, as an ideal range, one should choose between these two parameters 10 and 20%, which in practice means times of 10 seconds as a minimum and may go up to 60 seconds as a maximum depending on the cooling system.

Further in general terms, the proportions of the on-time $t_L$ of the linear compressor 10 and of the off-time $t_D$ should be adjusted depending on the system, and the off-time $t_D$ should change according to the capacity required by the cooling system, which may go from 1% turned on as a minimum (on very cold days and in houses without a heating system, garages and open places) to 100% turned on as a maximum (very high room temperature, food freezing, etc.).

In order to implement the functioning of the system of controlling a linear compressor of the present invention, one foresees a method having intermediate steps of actuating the linear compressor 10, alternating between on-time $t_L$ and off-time $t_D$, the linear compressor 10 being preferably actuated with a constant frequency and with a constant piston stroke during the on-time $t_L$, and a step of adjusting the on-time $t_L$ and off-time $t_D$ so that the evaporation pressure $P_E$ and the condensation pressure $P_C$ will be kept substantially constant, while respecting the fact that the off-time $t_D$ should be shorter than the time necessary for the evaporation pressure $P_E$ and the condensation pressure $P_C$ to equalize each other after turning off the linear compressor 10.

Among the advantages of the present invention, one can point out the fact that the linear compressor 10 may be operated with constant frequency and stroke. For this purpose it is enough that the compressor control system operates the linear compressor 10 intermittently, which makes the procedure easier and would lower the control and manufacture costs of the present invention.

In addition, according to the teachings of the present invention, the result of controlling the average temperature $T_M$ inside the environment to be cooled has a minor variation in the evaporation pressure $P_E$ and condensation pressure $P_C$. One can also achieve a thorough control of the level of average temperature $T_M$, since the capacity of the linear compressor may be modulated so as to vary from 0 to 100% according to the teachings of the present invention, which is not possible with the presently known systems.

A preferred embodiment having been described, one should understand that the scope of the present invention embraces other possible variations, being limited only by the contents of the accompanying claims, which include the possible equivalents.

The invention claimed is:

1. A linear-compressor control system comprising an electronic circuit controlling a linear compressor through an electric motor, the linear compressor comprising a cylinder and a piston;

the piston being arranged inside the cylinder and being driven by the electric motor and moving axially within the cylinder along a piston stroke between a top dead end and a bottom dead end, a compression chamber being arranged close to the top dead end and the piston compressing a fluid within the compression chamber, wherein:

the electronic circuit controls the electric motor intermittently through an on-time ($t_L$) and an off-time ($t_D$), throughout a time of operation of the linear compressor, the linear compressor being associated to a cooling closed circuit that comprises an evaporator and a condenser, a compressed fluid within the compression chamber being discharged into the cooling closed circuit, generating an evaporation pressure ($P_E$) inside the evaporator and a condensation pressure ($P_C$) inside the condenser, the evaporation pressure ($P_E$) and the condensation pressure ($P_C$) being kept constant throughout the time of operation of the linear compressor through an average value of on-time ($t_L$) of compressor capacity throughout the time of operation of the linear compressor, the electronic circuit actuating the electric motor and keeping the piston stroke constant, generating a constant compression capacity while the electronic circuit controls the electric motor for operation during the on-time ($t_L$), the system being configured so that the electronic circuit controls the on-time ($t_L$) and the off-time ($t_D$) to keep the compression capacity substantially constant throughout the time of operation of the linear compressor, and the off-time ($t_D$) being shorter than a time necessary for the evaporation pressure ($P_E$) and the condensation pressure (Pc) to match each other after the linear compressor has been turned off.

2. The linear-compressor control system according to claim 1, wherein the electronic circuit actuates the electric motor with a constant frequency.

3. The linear-compressor control system according to claim 2, wherein the off-time ($t_D$) of the linear compressor is substantially 20% of the time necessary for the evaporation pressure ($P_E$) and the condensation pressure ($P_C$) to equalize each other after the linear compressor has been turned off.

4. The linear-compressor control system according to claim 3, wherein the off-time ($t_D$) of the linear compressor is substantially 10% of the time necessary for the evaporation pressure ($P_E$) and the condensation pressure ($P_C$) to equalize each other after the linear compressor has been turned off.

5. The linear-compressor control system according to claim 4, wherein the on-time ($t_L$) of the linear compressor is substantially equal to the off-time ($t_D$).

6. The linear-compressor control system according to claim 5, wherein the off-time ($t_D$) and the on-time ($t_L$) are in a range of seconds.

7. The linear-compressor control system according to claim 6, wherein the off time ($t_D$) and the on-time ($t_L$) are each about 15 seconds.

8. A method of controlling a linear compressor, the linear compressor comprising a cylinder and a piston;

the piston comprising a fluid within the compression chamber and discharging it into a cooling closed circuit, generating an evaporation pressure ($P_E$) inside an evaporator and a condensation pressure ($P_C$) inside a condenser, the method comprising the steps of:

actuating the linear compressor intermittently, alternating between an on-time ($t_L$) and an off-time ($t_D$), the linear compressor being actuated with a constant piston stroke during the on-time ($t_L$), adjusting the on-time ($t_L$) and the off-time ($t_D$) so that the evaporation pressure ($P_E$) and the condensation pressure ($P_C$) is kept substantially constant, the off-time ($t_D$) being shorter than a time necessary for the evaporation pressure ($P_E$) and the condensation pressure ($P_C$) to match each other after the linear compressor has been turned off.

9. The method according to claim 8, wherein, in the step of actuating the linear compressor intermittently, the electric motor is actuated with a constant frequency.

10. The method according to claim 9, wherein the off-time (td) of the linear compressor is substantially 20% of the time necessary for the evaporation pressure ($P_E$) and the condensation pressure ($P_C$) to match each other after the linear compressor has been turned off.

11. The method according to claim 9, wherein the off-time ($t_D$) of the linear compressor is substantially 10% of the time necessary for the evaporation pressure ($P_E$) and the condensation pressure ($P_C$) to match each other after the linear compressor has been turned off.

12. The method according to claim 11, wherein the on-time ($t_L$) of the linear compressor is substantially equal to the off-time ($t_D$).

13. The method according to claim 12, wherein the off-time ($t_D$) and the on-time ($t_L$) are in a range of seconds.

14. The method according to claim 13, wherein the off-time ($t_D$) and the on-time ($t_L$) are of about 15 seconds.

15. A linear compressor, the linear compressor comprising a control system as defined in claim 1.

* * * * *